United States Patent [19]

Iyori et al.

[11] Patent Number: 4,983,212

[45] Date of Patent: Jan. 8, 1991

[54] CERMET ALLOYS AND COMPOSITE MECHANICAL PARTS MADE BY EMPLOYING THEM

[75] Inventors: Yuusuke Iyori; Hidetoshi Yokoo, both of Kumagaya, Japan

[73] Assignee: Hitachi Metals, Ltd., Tokyo, Japan

[21] Appl. No.: 381,706

[22] PCT Filed: Oct. 26, 1988

[86] PCT No.: PCT/JP88/01082

§ 371 Date: Jun. 23, 1989

§ 102(e) Date: Jun. 23, 1989

[87] PCT Pub. No.: WO89/03896

PCT Pub. Date: May 5, 1989

[30] Foreign Application Priority Data

Oct. 26, 1987 [JP] Japan ..... 62-268053
Dec. 11, 1987 [JP] Japan ..... 62-313643

[51] Int. Cl.[5] ..... C22C 29/04

[52] U.S. Cl. ..... 75/238; 75/236; 75/244; 75/242; 428/552

[58] Field of Search ..... 75/236, 238, 244, 242; 428/552

[56] References Cited

U.S. PATENT DOCUMENTS 3,878,592 4/1975 Humenik, Jr. et al. ..... 29/95 D
3,993,446 11/1976 Okawa ..... 29/182.7
4,049,380 9/1977 Yih et al. ..... 428/539.5
4,145,213 3/1979 Oskarsson et al. ..... 75/238
4,173,685 11/1979 Weatherly ..... 422/556
4,276,096 6/1981 Kolaska et al. ..... 148/166
4,289,833 9/1981 Hachisuka ..... 428/544
4,451,292 5/1984 Hall et al. ..... 75/238
4,701,381 10/1987 Jack ..... 428/548
4,843,039 6/1989 Akesson et al. ..... 501/87

*Primary Examiner*—Stephen J. Lechert, Jr.
*Assistant Examiner*—Leon Wigohosian, Jr.
*Attorney, Agent, or Firm*—Wenderoth, Lind & Ponack

[57] ABSTRACT

Disclosed are a cermet alloy having excellent wear resistance and strength at elevated temperatures, and a composite mechanical part containing a strong layer of any such cermet alloy formed on the outer or inner surface of an alloy base.

The materials which are used for making rolls, dies, punches, etc. are required to have excellent toughness, impact resistance, high-temperature strength and wear resistances. The conventional ultrahard WC—Co alloys are, however, unsatisfactory in high-temperature strength, through they have a satisfactorily high level of wear resistance. The conventional cermet alloys are low in toughness and impact strength, though they have high oxidation resistance. There has not been availabe any alloy that satisfies all of the requirements as hereinabove stated.

An energetic study has been made of the effects which the components of a cermet alloy may have on those requirements, and it has been found that all of those requirements can be satisfied by a cermet alloy which comprises a hard phase comprising 20 to 50% by weight of at least one of the carbides, nitrides and carbonitrides of Group IVa, VA and VIa elements and further containing at least one of the carbide, nitride and carbonitride of titanium, and a binding phase containing appropriate amounts of nickel and chromium. This cermet can be used to form a layer bonded to a surface of an alloy base to make a composite mechanical part.

11 Claims, 1 Drawing Sheet

CERMET ALLOYS AND COMPOSITE MECHANICAL PARTS MADE BY EMPLOYING THEM

TECHNICAL FIELD

This invention relates to cermet alloys having high degrees of wear resistance and strength at elevated temperatures, and various kinds of composite mechanical parts having a strong layer of a cermet alloy formed on the outer or inner surface of a base material.

BACKGROUND ART

The materials which are used for making rolls for rolling mills, dies, punches, etc. are required to having high degrees of toughness, impact resistance, high-temperature strength, etc. Therefore, it has been usual to employ cast steels, tool steels, etc. for those purposes. These materials have, however, the drawback of being low in wear resistance and being, therefore, capable of making only parts having a short life.

Attempts have, therefore, been made to improve the drawback of those materials by employing, for example, an ultrahard WC—Co alloy composed of a hard phase of WC and a binding phase of Co, or a cermet alloy composed of a hard phase of titanium compound, such as TiCN, and a binding phase of Ni.

The ultrahard WC-Co alloy consists mainly of WC and contains 15 to 25% by weight of Co which binds WC. As WC is essentially of high wear resistance, the alloy can make e.g. rolls of high wear resistance, as compared with the rolls formed from any conventional materials, such as cast or tool steels.

The ultrahard WC—Co alloy has, however, a number of drawbacks including (1) resulting in a part having a large weight, as WC, of which it mainly consists, has a high specific gravity (about 15), (2) being difficult to employ for making any part to be exposed to heat, as WC is liable to oxidation, particularly at high temperatures, and (3) being low in breaking or chipping resistance, as it contains only a small amount of binding phase and is substantially a lump of carbide particles.

The attempt to improve the chipping resistance of the ultrahard WC—Co alloy by increasing the amount of its binding phase (i.e. the amount of Co which it contains) results not only in a sharp reduction of wear resistance, but also in a reduction of hardness and toughness, if its Co extent exceeds 25% by weight, as is well known in the art. Therefore, a practically acceptable ultrahard WC—Co alloy is one containing 15 to 25% by weight of a binding phase.

The first cermet alloy appeared in the market in 1971. A great many attempts have since been made to obtain improved cermet alloys by employing carbides of Group IVa, Va and VIa metals, such as WC, TaC and NbC, for replacing a part of a titanium compound such as TiCN. The cermet alloys play an important role in the manufacture of cutting tools.

It is, however, known that if a cermet alloy contains over 40% by weight of a metal binding phase consisting basically of Ni, the binding phase between hard particles has an average thickness (m.f.p.) exceeding an adequate range for the alloy and resulting therefore in such a great reduction in strength of the alloy as to make it unsuitable for practical use, and that the amount of the binding phase in any such alloy should, therefore, be limited to a maximum of 40% by weight (see e.g. Hisashi Suzuki: "Ultrahard Alloys and Sintered Hard Materials" (Published by Maruzen), pages 307 to 372).

The conventional cermet alloys are, therefore, low in toughness and impact strength and unsatisfactory in breaking resistance, too, though they are light in weight and high in oxidation resistance, as compared with the ultrahard WC—Co alloys. Therefore, they have found only a limited scope of application to hot and cold working rolls, extrusion dies, or wire drawing dies.

It is usual to add a component, such as $Mo_2C$ or WC, to a cermet alloy to improve the wetting property of its hard phase composed of particles of a titanium compound (e.g. TiCN) with its binding metal phase. The component undergoes dissolution in the binding metal phase and precipitation in the hard phase during a sintering process and forms a structure surrounding the particles of the titanium compound and thereby improving their wetting property with the binding metal phase. Therefore, the conventional cermets usually comprise a composite carbonitride having a cored structure formed by a central portion which is rich in Ti, and a peripheral portion which is rich in e.g. WC or $Mo_2C$, but lean in Ti (see e.g. Japanese Patent Publication No. 51201/1981, or Japanese Patent Application laid open under No. 73857/1986, 210150/1986 or 201750/1986).

When any such cermet is used to make, for example, a roll, the benefit of the titanium compound which it contains cannot be obtained from the roll, since the surface of the carbonitride which is exposed as a result of the wear of the binding metal phase is easily oxidizable and soft, as it is lean in Ti, while it is rish in W. As the component, such as WC or $Mo_2C$, forms the peripheral portion, the particles of the carbontrile grow until they contact one another. The contacting portions of the particles are likely to become a source of fine cracks and open a path for the propagation of cracks. The more contacting portions the particles have, the lower the fracture toughness of the alloy becomes. The presence of those contacting portions also lowers the breaking resistance of the alloy. However, if the amount of the component, such as WC or $Mo_2C$, which is added is reduced to decrease those contacting portions, the high-temperature strength of the alloy is greatly lowered. Therefore, the addition of some of any such component is essential and the presence to some extent or other of such contacting portions is unavoidable.

Attempts have also been made to manufacture rolls and other parts having improved properties by employing a composite of different materials instead of a single material.

Practical use has come to be made of, for example, finishing rolls which are manufactured from an ultrahard WC—Co alloy used as a single material because of its high wear resistance. This alloy has, however, a high specific gravity (about 15), as already stated. Its specific gravity is nearly twice as high as that of cast or tool steel. The rolls manufactured from it are, therefore, greater in weight, and more likely to chatter or vibrate when they are operating. The greater weights of the rolls produces a greater force of inertia resulting in a greater difference between the peripheral velocity of the rolls and the speed at which the material to be rolled is passed therebetween. This difference creates between the rolls and the material to be rolled a large amount of slip which exerts an adverse effect of the quality of the material to be rolled.

A composite roll which is lighter in weight has been proposed to overcome the drawbacks of the roll made of a single material and comprise, for example, a core (inner layer) formed from a lightweight TiC—Ni cermet having a specific gravity of 5.1 and an outer layer formed from a wear-resistant ultrahard WC—Co alloy (see Japanese Patent Application laid open under No. 56147/1978). This roll, however, is easily broken and lacks reliability, since the cermet forming its inner layer is inferior in toughness to the ultrahard alloy. The residual stress which is due to the difference in coefficient of thermal expansion between the inner and outer layers of the roll is likely to disable them to maintain a proper bond and the roll is, therefore, likely to break, particularly when it is used for hot working.

There is also known a roll made by fitting a pressed cylinder of a WC—Co alloy about a sintered WC—Co alloy column and sintering them together (see Japanese Patent Application laid open under No. 84711/1976). This roll, however, still leaves unsolved the problem which is due to the high specific gravity of the ultrahard WC—Co alloy, though it may no longer have any problem due to the difference in coefficient of thermal expansion between the inner and outer layers.

There is also known a composite heat-resistant alloy part comprising a core formed from a heat-resistant alloy and having an outer surface coated by HIP with a powder of a corrosion-resistant alloy, such as a Ni-, Co- or or Fe-based alloy having a higher chromium content than the core alloy (see Japanese Patent Application laid open under No. 62103/1980). This part is, however, not fully satisfactory in wear resistance, despite its improved strength and corrosion resistance at elevated temperatures.

Under these circumstances, it is an object of this invention to provide a cermet alloy of high toughness, impact resistance and hardness which can be used for a wide scope of application including the manufacture of rolls and dies.

It is another object of this invention to provide a composite mechanical part of improved breaking resistance which is made by employing the cermet alloy of this invention and another appropriate material.

DISCLOSURE OF THE INVENTION

As used herein, the elements of Groups IVa, Va and VIa of the periodic table correspond to the elements of Groups IVb, Vb and VIb of the periodic table according to conventional U.S. nomenclature. The cermet alloy of this invention is particularly characterized by the proportion of the binding phase which it contains, and its composition. It contains 30 to 70% by weight of a hard phase, with the balance consisting of a binding phase and unavoidable impurities. The hard phase comprises 20 to 50% by weight of at least one of the carbides, nitrides and carbonitrides of Group IVa, Va and VIa elements and also contains at least one of the carbide, nitride and carbonitride of titanium. The binding phase contains Ni and Cr.

The cermet alloy of this invention also comprises 30 to 70% by weight of a hard phase obtained by replacing 1 to 70 mol % of titanium carbonitride with one or more of the carbides, nitrides, and carbonitrides of the elements of Groups IVa, Va and VIa of the periodic table, the balance consisting substantially of a binding phase containing Ni and Cr.

It is essential for the cermet alloy of this invention to contain Cr, as well as Ni, in its binding phase. More specifically, it contains 5 to 30% by weight of Cr and 20 to 40% by weight of Ni. The alloy has desired properties, particularly if the weight of Cr has a ratio of between 0.02 and 0.4 to the total weight of Ni and Cr in the binding phase.

Moreover, the nitrogen in the titanium carbonitride preferably has an atomic ratio of between 0.05 and 5 to the carbon.

The composite mechanical part of this invention comprises a base formed from an alloy made by a melting process, and a cermet alloy layer formed on the outer or inner surface of the base from a cermet alloy having a coefficient of thermal expansion falling within plus or minus 20% of that of the base alloy over a temperature range between room temperature and 1000° C. An alloy consisting mainly of iron can be used to form the base. This invention is also characterized by comprising a boundary phase formed in the boundary between the base and the cermet alloy layer and containing a greater proportion by weight of a component forming the binding phase of the cermet alloy than in the binding phase. The boundary phase enables the cermet alloy layer to form a particularly strong bond with the base made from the molten material to thereby ensure the realization of a composite mechanical part having particularly desirable properties, if it contains iron as the component forming the binding phase.

BEST MODE OF CARRYING OUT THE INVENTION

Figure 1:
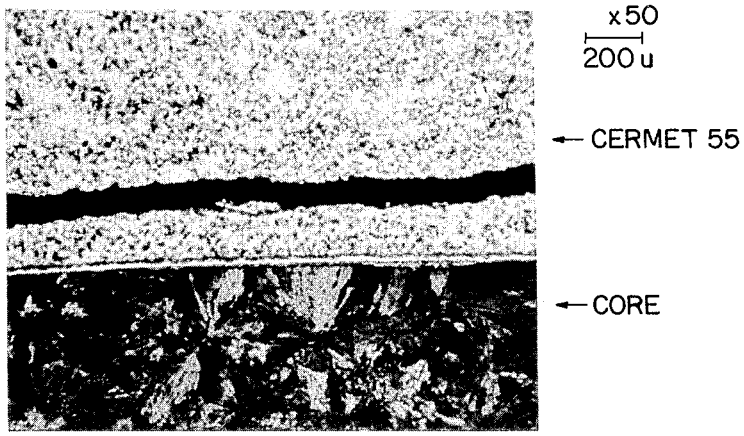
FIGS. 1 to 3 are photomicrographs showing the metallic structure of the junction between the core and the skin layer of three composite cermet rolls embodying this invention, respectively.

The cermet alloy of this invention contains 30 to 70% by weight of hard phase. A cermet alloy containing less than 30% by weight of hard phase has only a low degree of wear resistance, while one containing more than 70% by weight of hard phase has a very low degree of toughness. The alloy of this invention preferably contains 40 to 60% by weight of binding phase. Hardly any satisfactory toughness can be expected from an alloy containing more than 60% by weight of binding phase and no desired wear resistance or strength can be expected from any alloy containing less than 40% by weight of binding phase, particularly at elevated temperatures. More preferably, it contains 45 to 60% by weight of binding phase.

The hard phase in the cermet alloy of this invention consists mainly of titanium carbide, nitride or carbonitride and also contains one or more of the carbides and nitrides of the elements of Groups IVa, Va and VIa of the periodic table. A particularly desirable hard phase consists mainly of titanium carbonitride and contains one or more of the carbides and nitrides of Group IVa, Va and VIa elements which have been substituted for a part of the titanium carbonitride, as the substitution improves the toughness of the carbonitride, its wetting property with the binding phase and the high-temperature strength of the alloy. However, these improvements cannot be realized if the substitution amounts only to less than 1 mol % of titanium carbonitride, and if it amounts to more than 70 mol % thereof, the alloy lowers its wear and oxidation resistance.

According to this invention, it is desirable to ensure that the titanium carbonitride have a nitrogen to carbon atomic ratio between 0.05 and 5. If the ration is lower than 0.05, the particles of the hard phase become so coarse that its toughness is greatly lowered. If it exceeds 5, the carbonitride is decomposed to produce $N_2$ gas and thereby form micropores and also lowers its wetting property with the binding phase, resulting in a product of low flexural strength.

WC is a component which improves toughness and high-temperature strength and is employed in the amount of 5 to 40%. No appreciable improvement can be expected from the addition of only less than 5% of WC, while the addition of more than 40% results in a reduction of wear resistance.

Chromium carbide is likewise a component which improves toughness, high-temperature strength and oxidation resistance and is also employed in the amount of 5 to 40%. The addition of chromium carbide to the hard phase can be expected to improve resistance to oxidation, surface roughening and wear. No appreciable improvement can, however, be expected from the addition of only less than 5%, while the addition of more than 40% results in the formation of too large a peripheral portion leading to a reduction of toughness.

$Mo_2C$ is a component which improves wetting property and contributes to improving toughness and forming fine particles and is preferably employed in the amount of 1.5 to 10%. It is a soft material and the addition of more than 10% thereof results in a drastic reduction of wear resistance at elevated temperatures.

The carbide of a Group Va element, such as V, Nb or Ta, can improve high-temperature strength and plastic deformation resistance. It will sometimes be better to use NbC instead of a part or even all of chromium carbide, since it is more effective than chromium carbide for improving the performance of a tool, particularly one which is used at elevated temperatures. If any such carbide of a Group Va element is added, it is used in the amount of 5 to 40%. No appreciable improvement can be expected from the use of only less than 5% thereof, while the addition of more than 40% results in a reduction of toughness, as is the case with chromium carbide.

The binding phase in the cermet alloy of this invention contains Ni and Cr as its essential components. It may further contain any other Group IVa, Va or VIa element and unavoidable impurities. It may also contain less than 5% of Co without exerting any appreciable effect on the properties of the alloy. The alloy of this invention contains 30 to 70% by weight of binding phase. If the proportion of the binding phase is less than 30% by weight, it fails to have an approprite m.f.p. value and no improved toughness can, therefore, be expected. If the proportion of the binding phase exceeds 70% by weight, it fails to have an appropriate m.f.p. value, while the hard phase is coarsened, and the toughness of the alloy is too low to be practically acceptable. The proportion of the binding phase should, however, be held within the range of from 40 to 60%, and more preferably, from 45 to 60%, by weight, if appropriate properties, such as toughness and hardness, are to be obtained from, for example, a composite mechanical part made by employing a base prepared from a molten material.

The presence of chromium in the binding phase of the cermet alloy of this invention improves its wear resistance, as well as wetting property. Chromium is a very important component of the alloy of this invention, as for some reason or other, it enables a drastic increase of the appropriate m.f.p. value without causing any reduction of strength despite an increase in thickness of the binding phase. The binding phase preferably contains 5 to 30% by weight of Cr. If it contains only less than 5% by weight of Cr, the alloy has a lower oxidation resistance, while its toughness is lowered if the binding phase contains more than 30% by weight of Cr.

Nickel is another component forming the binding phase. The binding phase preferably contains 20 to 40% by weight of Ni. If it contains only less than 20% by weight of Ni, the alloy has a lower oxidation resistance, while its toughness is lowered if the binding phase contains more than 40% by weight of Ni.

The chromium in the binding phase preferably has a weight ratio of between 0.02 and 0.4 to the total amount of nickel and chromium. If its weight ratio is smaller than 0.02, no satisfactory result can be expected, but if it is greater than 0.4, the excessive precipitation of chromium carbide brings about a reduction of toughness.

The hard phase of the cermet alloy of this invention may have a cored structure which is identical to that of the known cermet alloy. Alternatively, it may contain 50 to 90% by weight of a composite carbonitride having a cored structure of the reversed nature, i.e. comprising a composite carbonitride which is relatively lean in Ti and rich in W and/or Mo, and which is surrounded by a composite carbonitride which is relatively rich in Ti and lean in W and/or Mo. An alloy containing a hard phase of which at least 50% by weight consists of a composite carbonitride of the latter cored structure, and having desired properties, can be obtained if a multiple composite carbonitride containing at least W and Ti, and also one or more of Group IVa, Va and VIa elements, is employed as a starting material, and sintered with TiN or TiCN, and the powders of metals forming a binding phase, as well as other carbide, nitride or carbonitride, if required.

If a multiple composite carbonitride containing at least W and Ti, and further containing one or more of Group IVa, Va and VIa elements forming the peripheral portion of the hard phase, such as $Cr_3C_2$, NbC or $Mo_2C$, is employed as a starting material, the hard phase has a good wetting property with the binding metal phase and does not cause any great reduction of toughness or sinterability, since the composition of the starting material is relatively close to that of the peripheral portion as hereinabove stated. Moreover, insofar as the starting material contains a part of the material forming the peripheral portion, it is possible to reduce the amount of the peripheral portion which has to be formed during sintering, and thereby decrease the contacting portions of particles of the composite carbonitride.

It is, however, not sufficient to employ the composite carbonitride alone. When it is sintered, the component forming the peripheral portion which it contains is dissolved in the binding phase to form a solid solution which is continuously precipitated on the particles of the carbonitride to cause their growth and thereby the formation of their contacting portions which disable the realization of any desired breaking resistance. Moreover, the composite carbonitride does not form a layer structure having a peripheral portion which is rich in Ti. According to this invention, therefore, it is important to add TiN or TiCN. The addition of TiN or TiCN is considered to be effective for the following three reasons:

(1) Both TiN and TiCN are thermodynamically unstable at elevated temperatures and are particularly unstable when there is a source of carbon supply in their neighborhood. If TiN or TiCN is added, therefore, the particles thereof are thermally decomposed during sintering to form a solid solution predominantly in the binding metal phase. As a result, the component forming the peripheral portion which the composite carbonitride contains, such as Mo, Ta or Nb, is restricted from forming a solid solution in the binding phase. The formation of the peripheral portion is restricted, and the contacting of the carbonitride particles is greatly reduced.

(2) As Ti and N resulting from the thermal decomposition of TiN or TiCN are diffused to form a solid solution in the carbonitride particles, the carbonitride particles form a layer structure having a peripheral portion which is rich in Ti, and the carbonitride has, therefore, a layer structure having a hard and oxidation-resistant surface.

(3) When Ti and N which have formed a solid solution in the binding metal phase are diffused into the carbonitride particles, W having no affinity for N is expelled from those particles and forms a solid solution in the binding metal phase to strengthen it greatly.

As a result, it is apparently possible to obtain an excellent cermet alloy having an improved breaking resistance for the reason as set forth at (1) above, an improved high-temperature wear resistance for the reason as set forth at (2), and an improved high-temperature strength for the reason as set forth at (3).

According to this invention, there is also provided a composite mechanical part which comprises a tough base, and a light and hard cermet alloy layer formed on the outer or inner surface of the base. The base is preferably prepared from a molten material, e.g. an alloy designated as SCM440, so as to have a desired level of toughness. The cermet alloy layer preferably has a coefficient of thermal expansion which falls within plus or minus 20% of that of the base over the entire temperature range between room temperature and 1000° C., so that no large residual stress may exist between the base and the cermet alloy layer, but so that they may maintain a strong junction having no crack. When the cermet alloy of this invention is employed, the base and the cermet alloy layer form a strong junction owing to the formation therebetween of a boundary phase (considered as an austenite phase) having a greater proportion by weight than the binding phase forming the cermet, or a diffusion phase.

When the base is prepared from a molten material, it is preferable to substitute iron for a part or all of nickel in the binding phase of the cermet to ensure the effective formation of the boundary phase.

EXAMPLE 1

Powders of $TiC_{0.8}N_{0.2}$, WC and $Mo_2C$ having a particle size of 1 to 6 microns as the materials forming a hard phase, and powders of Ni and Cr as the metals forming a binding phase were mixed in different proportions enabling the preparation of Samples Nos. 1 to 10 of cermet alloys having different compositions as shown in TABLE 1. Each mixture of the powders was prepared by mixing in an ultrahard ball mill rotating at a high speed for about 96 hours, and after it had been dried, it was pressed in a mold to form a compacted product. Each compacted product was held at a temperature of 1300° C. to 1450° C. for about 60 minutes in a vacuum having a pressure of $10^{-2}$ to $10^{-3}$ mm Hg, whereby a cermet alloy was produced.

Each sample was examined for flexural strength, fracture toughness, energy absorption and hardness. The results are shown in TABLE 2.

As is obvious from TABLE 2, Samples Nos. 4 to 9 of this invention having a hard-phase proportion of 30 to 70% by weight were superior to Comparative Samples Nos. 1 to 3 and 10 in toughness, flexural strength and hardness. Samples Nos. 5 to 7 having a hard-phase proportion of 45 to 55% by weight showed particularly good properties.

The values of fracture toughness shown in TABLE 2, except those of Samples Nos. 1 to 3, were determined by an indentation test conducted to measure the length of a crack which had been formed by a Vickers indenter under a load of 50 kg. The toughness of each of Samples Nos. 1 to 3 was too low to be determined by that method.

EXAMPLE 2

EXAMPLE 1 was followed to prepare samples of alloys having different compositions as shown in TABLE 3. Each sample was examined for flexural strength, fracture toughness, energy absorption and hardness. The results are shown in TABLE 4.

As is obvious from TABLE 4, Samples Nos. 12 to 16, 18 and 19 containing titanium carbonitride having an N/C ratio of between 0.05/1 and 5/1 were superior to the other samples (Nos. 11 and 17) in toughness and flexural strength. They also showed a higher level of energy absorption and were, therefore, found to be of higher breaking strength.

EXAMPLE 3

EXAMPLE 1 was followed to prepare samples of cermet alloys having different compositions as shown in TABLE 5. Each sample was examined for flexural strength, fracture toughness, energy absorption and hardness. The results are shown in TABLE 6. Samples Nos. 21 to 25 and 27 to 36 in which one or more of carbides and nitrides of Group IVa, Va and VIa elements had been substituted for 1 to 70 mol % of titanium carbonitride were superior in toughness and flexural strength to the other samples, i.e. Sample No. 20 in which such a carbide had been substituted for only less than 1 mol %, and Sample No. 26 in which such carbides and nitrides had been substituted for more than 70 mol %.

According to this invention, therefore, it is obviously preferable to substitute one or more of carbides and nitrides of Group IVa, Va and VIa elements for 1 to 70 mol % of TiCN.

EXAMPLE 4

EXAMPLE 1 was followed to prepare samples of cermet alloys having different compositions as shown in TABLE 7. Each sample was examined for flexural strength, fracture toughne-s, energy absorption and hardness. The results are shown in TABLE 8.

As is obvious from TABLE 8, Samples Nos. 38 to 43 having a Cr/Ni+Cr weight ratio in the binding phase of between 0.02 and 0.4 were superior in toughness and flexural strength to the other samples, i.e. Sample No. 37 having a lower Cr ratio and Sample No. 44 having a higher Cr ratio.

According to this invention, therefore, it is preferable to ensure that the binding phase have a Cr/Ni+Cr weight ratio of between 0.02 and 0.4.

EXAMPLE 5

Commercially available powders of WC, $TiC_{0.7}N_{0.3}$, Cr, NbC and $Mo_2C$ having an average crystal grain diameter of 1.0 to 1.5 microns were weighed and mixed in a wet system for the preparation of multiple composite carbonitrides used to prepare Samples Nos. 45 to 48 as shown in TABLE 9. Each mixture was subjected to one hour of solution treatment at a temperature of 1800° C. in an atmosphere having an $N_2$ partial pressure of 20 to 30 torr and was, then, crushed in a turret mill to prepare a multiple composite carbonitride as a starting material.

A compound, such as TiCN or NbC, and binding metals, as shown in TABLE 9, were admixed with each carbonitride that had been prepared, whereby samples of cermet alloys having different compositions as shown in TABLE 9 were prepared. TABLE 9 also shows Comparative Samples Nos. 49 and 50 which had been prepared by one hour of sintering at a temperature of 1400° C. in an atmosphere having an $N_2$ partial pressure of 1 torr. TABLE 10 shows the results which were obtained from the examination of each sample for hardness, fracture toughness, flexural strength, etc. The contact ratio appearing in TABLE 10 is the ratio of the surface area of contacting portions of composite carbonitride particles to the total surface area thereof, as determined by the Gurland's method. The fracture time was determined by a high-temperature short-time creep test conducted by employing a stress of 80 kg/mm$^2$ at a temperature of 900° C. and is given in TABLE 10 to show the high-temperature strength of each sample.

As is obvious from TABLE 10, Samples Nos. 45 to 48 which had been prepared by adding TiN or TiCN to the multiple composite carbonitride had a lower contact ratio and a higher fracture toughness than those of Comparative Samples Nos. 49 and 50, and also showed a longer fracture time from the high-temperature short-time creep test, apparently because of the reinforcement of the binding metal layer by W expelled from the composite carbonitride.

EXAMPLE 6

Powders of starting materials as shown in TABLE 11 were mixed to prepare samples of cermet alloys each containing 23% TiCN, 10% WC, 7% $Cr_3C_2$, 3% NbC, 7% $Mo_2C$, 40% Ni and 10% Cr, by weight. Each sample was analyzed for the composition of each of the central and peripheral portions of its cored structure. The results are shown in TABLE 12. The analysis was conducted quantitatively by employing a transmission type analyzing electron microscope. As is obvious from TABLE 12, the use of different starting materials resulted in the production of alloys having a cored structure formed by a central portion which was relatively lean in Ti and rich in W, and a peripheral portion which was rich in Ti and lean in W (Samples Nos. 51 and 52), and alloys having a cored structure of the opposite nature (Samples Nos. 53 and 54).

EXAMPLE 7

Eight samples of cermet alloys as shown in TABLE 13 were prepared and were each examined for oxidation resistance. Each sample was heated from room temperature to 1000° C. and its weight gain by oxidation was determined. The results are shown in TABLE 13.

Sample No. 55 showed a weight gain by oxidation of $28\times10^{-2}$ mg/mm$^2$, i.e. a relatively low oxidation resistance, apparently because of its binding phase containing only 6% by weight of Cr and its hard phase containing only 6% by weight of $Cr_3C_2$. On the other hand, Sample No. 56 having a hard phase containing 21% by weight of $Cr_3C_2$ showed a weight gain by oxidation of $15\times10^{-2}$ mg/mm$^2$, i.e. a relatively high oxidation resistance. Sample No. 57 having a binding phase containing 8% by weight of Cr and a hard phase containing 24% by weight of $Cr_3C_2$ showed a weight gain by oxidation of only $11\times10^{-2}$ mg/mm$^2$, i.e. a high oxidation resistance.

Sample No. 58 contained as much as 24% by weight of $Cr_3C_2$ in its hard phase, but was relatively low in oxidation resistance as it showed a weight gain of $24\times10^{-2}$ mg/mm$^2$. Its low oxidation resistance was apparently due to its binding phase containing only 4% by weight of Cr.

Sample No. 59 also showed a good oxidation resistance. It, however, had a flexural strength of only 51 kg/mm$^2$, as its binding phase contained as much as 31% by weight of Cr. Incidentally, Sample No. 56 containing an appropriate amount of Cr showed a flexural strength of 190 kg/mm$^2$. All of Samples Nos. 60 to 62 containing 8% by weight of Cr in their binding phase showed a small weight gain by oxidation, i.e. a good oxidation resistance.

It is obvious from these results that it is preferable for the cermet alloy of this invention to contain at least 5% by weight of Cr in its binding phase to achieve high oxidation resistance, though the appropriate chromium content of its binding phase may depend on the chromium carbide content of its hard phase, too.

EXAMPLE 8

Three cylindrical members each having an outside diameter of 140 mm, an inside diameter of 50 mm and a length of 85 mm were formed as cores for rolls from an SCM440 alloy which had been produced by melting. A skin was prepared by the CIP molding at a pressure of 500 to 1000 kg/cm$^2$ of each of three cermet alloys which had been produced by mixing the materials as shown in TABLE 14 in a ball mill. The skin of each alloy was fitted about one of the cores and was preliminarily sintered at a temperature of 1000° C. to 1300° C., whereby it was caused to contract and fit the core integrally. Then, the core and skin assembly was subjected to two hours of HIP treatment at a temperature between the preliminary sintering temperature and the temperature which was 25° C. lower than it, and a pressure of 1000 atoms. Thus, three composite cermet rolls were obtained. Each roll had an outside diameter of 250 mm, an inside diameter of 140 mm and a length of 85 mm.

The total amount of the carbide, nitride and carbonitride of Group IVa, Va and VIa elements forming the hard phase of the cermets was kept within the range of 40 to 55% by weight, so that they might have appropriate toughness, as well as satisfactory wear resistance.

Each roll was examined with respect to the difference in coefficient of thermal expansion between its core and cermet skin. The results are shown in TABLE 14. TABLE 14 shows the maximum difference that was found in each roll over a temperature range between room temperature and 1000° C.

Figure 2:
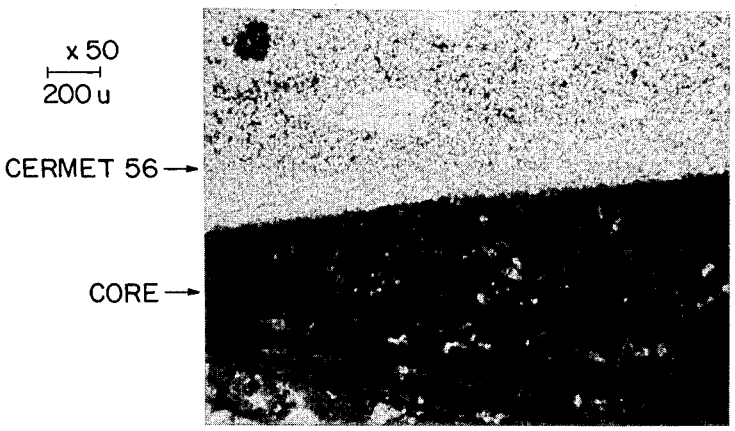
Figure 3:
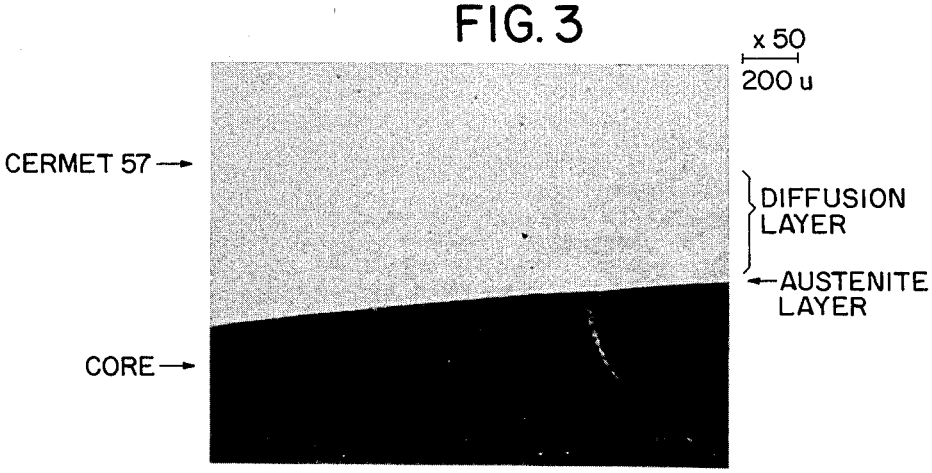

The junction between the core and skin of each roll was examined through an optical microscope. FIGS. 1 to 3 are each a photomicrograph of a section of the junction in one of the rolls.

FIG. 1 is the photomicrograph showing a section of the roll made by employing Sample No. 55 for its cermet skin. It shows a large crack in the cermet. This cracking was apparently due to the difference of as large as 25% in coefficient of thermal expansion between the core and the skin.

FIG. 2 is the photomicrograph showing a section of the roll made by employing Sample No. 56. It shows a good junction or boundary between the core and the skin apparently owing to the fact that the difference in coefficient of thermal expansion between the core and the skin was as small as 18%.

FIG. 3 is the photomicrograph showing a section of the roll made by employing Sample No. 57. A diffusion layer and an austenite layer are found between the core and the skin and form a still better junction therebetween, apparently due to the fact that the core and the skin had a difference of only 5% in coefficient of thermal expansion, and that the nickel and chromium contents of the alloy were both within the range of 5 to 30% by weight.

It is, therefore, obvious that the composite cermet roll of this invention has a strong and crack-free skin joined to its core if the core has a coefficient of thermal expansion falling within plus or minus 20% of that of the skin.

Although the core has been described as having been formed from SCM440, it is, of course, possible to use any other material prepared by melting and having a coefficient of thermal expansion which is substantially equal to that of the cermet alloy of this invention. More specifically, it is possible to use, for example, an SKD11 or HRA286 alloy to make an appropriate core which provides a roll when a skin is fitted about it. Although the invention has been described as having been applied to rolls, this invention is not limited to rolls, but is equally applicable to various kinds of other composite mechanical parts, components or members.

INDUSTRIAL UTILITY

The cermet alloy of this invention is not only useful for making cutting tools, but also can be used effectively for other purposes including the manufacture of rolls, dies, cylinders and guide rollers which are used at a low or high temperature, since it has high levels of flexural strength and hardness and is also excellent in wear resistance and strength at elevated temperatures.

TABLE 1

| Sample No. | Composition: Hard phase (wt %) Composition (mol %) TiCN | WC | $Mo_2C$ | | Binding phase (wt %) Ni | Cr |
|---|---|---|---|---|---|---|
| 1 | 80 | 15 | 5 | 10 | 72 | 18 |
| 2 | 80 | 15 | 5 | 20 | 64 | 16 |
| 3 | 80 | 15 | 5 | 27 | 58 | 15 |
| 4 | 80 | 15 | 5 | 30 | 56 | 14 |
| 5 | 80 | 15 | 5 | 40 | 48 | 12 |
| 6 | 80 | 15 | 5 | 50 | 40 | 10 |
| 7 | 80 | 15 | 5 | 55 | 36 | 9 |
| 8 | 80 | 15 | 5 | 60 | 32 | 8 |
| 9 | 80 | 15 | 5 | 70 | 24 | 6 |
| 10 | 80 | 15 | 5 | 80 | 15 | 5 |

TABLE 2

| Sample No. | Flexural strength ($kg/mm^2$) | Fracture toughness $K_{1c}(MPam^{\frac{1}{2}})$ | Absorbing energy ($kg \cdot cm/mm^2$) | Hardness $Hr_A$ |
|---|---|---|---|---|
| 1 | 15 | | 0.5 | 82.1 |
| 2 | 21 | | 0.6 | 82.2 |
| 3 | 102 | | 1.0 | 82.5 |
| 4 | 220 | 26 | 1.8 | 83.5 |
| 5 | 273 | 29 | 1.9 | 83.8 |
| 6 | 295 | 29 | 2.0 | 84.1 |
| 7 | 130 | 24 | 1.9 | 85.2 |
| 8 | 135 | 15 | 1.1 | 86.1 |
| 9 | 127 | 14 | 1.0 | 86.5 |
| 10 | 120 | 10 | 0.9 | 91.3 |

TABLE 3

| Sample No. | Composition: Hard phase (wt %) Composition (mol %) TiCN | WC | MoC | NbC | Tac | | Binding phase (wt %) Ni | Cr | Co | Fe | N/c in TiCN |
|---|---|---|---|---|---|---|---|---|---|---|---|
| 11 | 60 | 20 | 10 | 5 | 5 | 40 | 42 | 18 | — | — | 0.04/1 |
| 12 | 60 | 20 | 10 | 5 | 5 | 40 | 42 | 18 | — | — | 0.05/1 |
| 13 | 60 | 20 | 10 | 5 | 5 | 40 | 42 | 18 | — | — | 0.5/1 |
| 14 | 60 | 20 | 12 | 5 | 5 | 40 | 42 | 18 | — | — | 1/1 |
| 15 | 60 | 20 | 10 | 5 | 5 | 40 | 42 | 18 | — | — | 2/1 |
| 16 | 60 | 20 | 10 | 5 | 5 | 40 | 42 | 18 | — | — | 5/1 |
| 17 | 60 | 20 | 10 | 5 | 5 | 40 | 42 | 18 | — | — | 6/1 |
| 18 | 70 | 10 | 10 | — | 10 | 48 | 40 | 10 | 1 | 1 | 0.5/1 |
| 19 | 70 | 10 | 10 | — | 10 | 48 | 20 | 7 | 20 | 5 | 0.5/1 |

TABLE 4

| Sample No. | Flexural strength ($kg/mm^2$) | Fracture toughness $K_{1c}(MPam^{\frac{1}{2}})$ | Absorbing energy ($kg \cdot cm/mm^2$) | Hardness $Hr_A$ |
|---|---|---|---|---|
| 11 | 140 | 17 | 1.3 | 84.0 |
| 12 | 254 | 23 | 2.1 | 84.2 |
| 13 | 261 | 23 | 2.1 | 84.2 |
| 14 | 268 | 23 | 2.1 | 84.3 |
| 15 | 275 | 24 | 2.2 | 84.4 |
| 16 | 285 | 28 | 2.4 | 84.4 |
| 17 | 140 | 19 | 1.4 | 84.2 |
| 18 | 277 | 27 | 1.9 | 84.4 |
| 19 | 282 | 27 | 1.9 | 84.4 |

TABLE 5

| Sample No. | Composition: Hard phase (wt %) Composition (mol %) TiCN | WC | MoC | VC | NbC | TaC | ZrC | HfC | NbN | TaN | TiC | Binding comp. (wt %) | Ni | Cr | N/c in TiCN |
|---|---|---|---|---|---|---|---|---|---|---|---|---|---|---|---|
| 20 | 99.5 | — | 0.5 | — | — | — | — | — | — | — | — | 48 | 42 | 10 | 1/9 |

TABLE 5-continued

| Sample No. | Composition: Hard phase (wt %) Composition (mol %) TiCN | WC | MoC | VC | NbC | TaC | ZrC | HfC | NbN | TaN | TiC | Binding comp. (wt %) Ni | Cr | N/c in TiCN |
|---|---|---|---|---|---|---|---|---|---|---|---|---|---|---|
| 21 | 99 | — | 1 | — | — | — | — | — | — | — | — | 48 | 42 | 10 | 1/9 |
| 22 | 90 | — | 10 | — | — | — | — | — | — | — | — | 48 | 42 | 10 | 1/9 |
| 23 | 70 | 10 | 10 | — | — | 10 | — | | — | — | — | 48 | 42 | 10 | 1/9 |
| 24 | 50 | 10 | 10 | 5 | 10 | — | 5 | — | 10 | — | — | 48 | 42 | 10 | 1/9 |
| 25 | 30 | 30 | 10 | 5 | 5 | 5 | 5 | 5 | 5 | — | — | 48 | 42 | 10 | 1/9 |
| 26 | 25 | 30 | 10 | 5 | 5 | 5 | 5 | 5 | 5 | 5 | — | 48 | 42 | 10 | 1/9 |
| 27 | 80 | 10 | 10 | — | — | — | — | | | | | 48 | 42 | 10 | 1/9 |
| 28 | 80 | — | 10 | 10 | — | — | — | — | | | | 48 | 42 | 10 | 1/9 |
| 29 | 80 | — | 10 | — | 10 | — | — | — | | | | 48 | 42 | 10 | 1/9 |
| 30 | 70 | 10 | 10 | — | — | 10 | — | — | | | | 48 | 42 | 10 | 1/9 |
| 31 | 70 | 10 | 10 | — | — | — | 10 | — | | | | 48 | 42 | 10 | 1/9 |
| 32 | 70 | 10 | 10 | — | — | — | — | 10 | — | — | | 48 | 42 | 10 | 1/9 |
| 33 | 70 | 10 | 10 | — | — | — | — | — | 10 | — | — | 48 | 42 | 10 | 1/9 |
| 34 | 70 | 10 | 10 | — | — | — | — | — | — | 10 | — | 48 | 42 | 10 | 1/9 |
| 35 | 90 | — | — | — | — | — | — | — | — | — | 10 | 48 | 42 | 10 | 1/9 |
| 36 | 80 | — | — | — | 10 | 10 | — | — | — | — | — | 48 | 42 | 10 | 1/9 |

TABLE 6

| Sample No. | Flexural strength (kg/mm$^2$) | Fracture toughness $K_{1c}$(MPam$^{\frac{1}{2}}$) | Absorbing energy (kg · cm/mm$^2$) | Hardness $Hr_A$ |
|---|---|---|---|---|
| 20 | 135 | 15 | 1.4 | 84.1 |
| 21 | 145 | 20 | 1.6 | 84.3 |
| 22 | 275 | 27 | 1.9 | 84.2 |
| 23 | 281 | 28 | 2.0 | 84.3 |
| 24 | 299 | 30 | 2.1 | 84.3 |
| 25 | 287 | 29 | 2.0 | 84.3 |
| 26 | 137 | 16 | 1.4 | 84.4 |
| 27 | 280 | 28 | 1.9 | 84.3 |
| 28 | 285 | 26 | 1.8 | 84.3 |
| 29 | 292 | 31 | 2.0 | 84.4 |
| 30 | 290 | 27 | 2.1 | 84.3 |
| 31 | 273 | 26 | 2.0 | 84.2 |
| 32 | 270 | 25 | 1.9 | 84.3 |
| 33 | 282 | 28 | 1.9 | 84.2 |
| 34 | 273 | 29 | 1.8 | 84.4 |
| 35 | 295 | 30 | 2.0 | 84.4 |
| 36 | 298 | 31 | 2.2 | 84.6 |

TABLE 8

| Sample No. | Flexural strength (kg/mm$^2$) | Fracture toughness $K_{1c}$(MPam$^{\frac{1}{2}}$) | Absorbing energy (kg · cm/mm$^2$) | Hardness $Hr_A$ |
|---|---|---|---|---|
| 37 | 133 | 17 | 1.3 | 84.4 |
| 38 | 151 | 22 | 1.7 | 84.4 |
| 39 | 184 | 23 | 1.8 | 84.3 |
| 40 | 205 | 24 | 1.9 | 84.3 |
| 41 | 291 | 29 | 2.0 | 84.3 |
| 42 | 290 | 29 | 2.0 | 84.3 |
| 43 | 199 | 23 | 1.8 | 84.2 |
| 44 | 142 | 17 | 1.3 | 84.2 |

TABLE 9

| Sample No. | Composition (wt %) Tic | TiN | WC | CrC | NbC | $Mo_2C$ | Ni | Cr | Material Employed |
|---|---|---|---|---|---|---|---|---|---|
| 45 | 18 | 7 | 20 | 4 | — | 6 | 38 | 7 | (TiWCrMo)CN + TiCN + Ni + Cr |
| 46 | 16 | 7 | 10 | 7 | 3 | 7 | 43 | 7 | (TiWCrMo)CN + NbC + TiCN + Ni + Cr |
| 47 | 18 | 7 | 10 | — | 10 | 5 | 43 | 7 | (TiWNbMo)CN + TiCN + Ni + Cr |
| 48 | 15 | 7 | 15 | 6 | 2 | 6 | 38 | 7 | (TiWCr) + TiCN + NbC + $Mo_2C$ + Ni + Cr |
| 49 | 18 | 7 | 14 | 7 | 3 | 6 | 45 | | (Ti,W)CN + Cr + NbC + $Mo_2C$ + Ni |
| 50 | 16 | 7 | 10 | 10 | — | 7 | 50 | | TiCN + WC + Cr + $Mo_2C$ + Ni |

TABLE 10

| Sample No. | Hardness $Hr_A$ | Fracture toughness (MPam$^{\frac{1}{2}}$) | Flexural strength (kg/mm$^2$) | Fracture time (min.) | Contact ratio |
|---|---|---|---|---|---|
| 45 | 84.2 | 27 | 275 | 65 | 0.16 |
| 46 | 84.1 | 29 | 295 | 71 | 0.13 |
| 47 | 84.3 | 28 | 281 | 95 | 0.15 |
| 48 | 84.3 | 30 | 299 | 85 | 0.18 |
| 49 | 84.1 | 19 | 200 | 15 | 0.25 |

TABLE 7

| Sample No. | Composition: Hard phase (wt %) Composition (mol %) TiCN | WC | MoC | | Binding phase (wt %) Ni | Cr | Cr/Ni + Cr | N/c in TiCN |
|---|---|---|---|---|---|---|---|---|
| 37 | 70 | 20 | 10 | 45 | 54.5 | 0.6 | 0.01 | 3/7 |
| 38 | 70 | 20 | 10 | 45 | 53.9 | 1.1 | 0.02 | 3/7 |
| 39 | 70 | 20 | 10 | 45 | 52.2 | 2.8 | 0.05 | 3/7 |
| 40 | 70 | 20 | 10 | 45 | 49.5 | 5.5 | 0.1 | 3/7 |
| 41 | 70 | 20 | 10 | 45 | 44 | 11 | 0.2 | 3/7 |
| 42 | 70 | 20 | 10 | 45 | 38.5 | 16.5 | 0.3 | 3/7 |
| 43 | 70 | 20 | 10 | 45 | 33 | 22 | 0.4 | 3/7 |
| 44 | 70 | 20 | 10 | 45 | 30 | 25 | 0.45 | 3/7 |

TABLE 10-continued

| Sample No. | Hardness $Hr_A$ | Fracture toughness ($MPam^{\frac{1}{2}}$) | Flexural strength ($kg/mm^2$) | Fracture time (min.) | Contact ratio |
|---|---|---|---|---|---|
| 50 | 83.9 | 22 | 210 | 25 | 0.28 |

TABLE 11

| Sample No. | Materials employed |
|---|---|
| 51 | (TiWCrNbMo)CN + TiCN |
| 52 | (TiWCrMo)CN + TiN + NbC |
| 53 | TiCN + WC + Cr + NbC + $Mo_2C$ |
| 54 | (TiCr)CN + WC + NbC + $Mo_2C$ |

TABLE 12

| Sample No. | Central portion | | | | | Peripheral portion | | | | |
|---|---|---|---|---|---|---|---|---|---|---|
| | Ti | W | Cr | Nb | Mo | Ti | W | Cr | Nb | Mo |
| 51 | 16.0 | 35.9 | 8.1 | 7.6 | 7.0 | 29.1 | 24.3 | 8.3 | 8.8 | 7.5 |
| 52 | 15.8 | 36.6 | 8.0 | 7.7 | 7.1 | 60.5 | 23.3 | 8.5 | 8.9 | 7.5 |
| 53 | 60.5 | 3.2 | 2.5 | 5.6 | 6.0 | 49.5 | 23.3 | 15.5 | 7.7 | 7.5 |
| 54 | 50.1 | 3.2 | 18.0 | 5.5 | 5.9 | 40.1 | 25.8 | 9.5 | 9.5 | 7.5 |

TABLE 13

| No. | Fe | Co | Ni | Cr | TiCN | $Cr_3C_2$ | $Mo_2C$ | WC | VC | $Cr_7C_3$ | Grain by oxidation |
|---|---|---|---|---|---|---|---|---|---|---|---|
| 55 | 36 | 3 | — | 6 | 19 | 6 | 11 | 3 | 6 | — | 28 |
| 56 | 46 | 3 | — | 6 | 10 | 21 | 5 | 3 | 6 | — | 15 |
| 57 | 33 | — | 5 | 8 | 12 | 24 | 7 | 3 | 8 | — | 11 |
| 58 | 38 | — | 4 | 4 | 12 | 24 | 7 | 3 | 8 | — | 24 |
| 59 | 10 | — | 5 | 31 | 12 | 24 | 7 | 3 | 8 | — | 9 |
| 60 | 33 | — | 5 | 8 | 12 | — | 7 | 3 | 8 | 24 | 10 |
| 61 | 33 | — | 5 | 8 | 12 | 12 | 7 | 3 | 8 | 12 | 11 |
| 62 | Identical to No. 61 except $(Cr,Fe)_7C_3$ used instead of $Cr_3C_2$ | | | | | | | | | | 11 |

TABLE 14

| Sample No. | Composition (wt %) | | | | | | | | | Difference in coefficient of thermal expansion (%) |
|---|---|---|---|---|---|---|---|---|---|---|
| | Fe | Co | Ni | Cr | TiCN | $Cr_3C_2$ | $Mo_2C$ | WC | VC | |
| 55 | 46 | 9 | — | — | 19 | 6 | 11 | 3 | 6 | 25 |
| 56 | 46 | 9 | — | — | 10 | 21 | 5 | 3 | 6 | 18 |
| 57 | 33 | — | 5 | 8 | 12 | 24 | 7 | 3 | 8 | 5 |

We claim:

1. A cermet alloy consisting essentially of 30 to 70% by weight of a hard phase and a balance of a binding phase and unavoidable impurities, said hard phase comprising 20 to 50% by weight of at least one selected from the group consisting of the carbides of the Group IVa, Va and VIa elements and nitrides of Zr, V, Nb and Ta, and further containing at least one selected from the group consisting of titanium carbide, titanium nitride and titanium carbonitride, while said binding phase contains 20 to 40% by weight of nickel and 5 to 30% by weight of chromium.

2. A cermet alloy consisting essentially of 30 to 70% by weight of a hard phase and a balance of a binding phase containing nickel and chromium, said hard phase comprising titanium carbonitride and at least one selected from the group consisting of the carbides, nitrides and carbonitrides of Group IVa, Va and VIa elements in the periodic table which has been substituted for 1 to 70 mol % of said titanium carbonitride.

3. The cermet alloy as set forth in claim 2, wherein said binding phase contains 20 to 40% by weight of said nickel and 5 to 30% by weight of said chromium.

4. The cermet alloy as set forth in claim 2 or 3, wherein said titanium carbonitride has an atomic nitrogen ratio of between 0.05 and 5 to carbon.

5. The cermet alloy as set forth in claim 2 or 3 wherein said chromium in said binding phase has a weight ratio of between 0.02 and 0.4 to the total amount of said nickel and said chromium.

6. A composite mechanical part comprising a base formed from an alloy produced by melting, and a layer of a cermet alloy formed on a surface of said base, said cermet alloy having a coefficient of thermal expansion falling within 20% of that of said base alloy over a temperature range between room temperature and 1000° C., said cermet alloy consisting essentially of 30 to 70% by weight of a hard phase and a balance of a binding phase and unavoidable impurities, said hard phase comprising 20–50% by weight of at least one selected from the group consisting of the carbides of the Group IVa, Va and VIa elements and nitrides of Zr, V, Nb and Ta, and further containing at least one selected from the group consisting of titanium carbide, titanium nitride and titanium carbonitride, while said binding phase contains 20 to 40% by weight of nickel and 5 to 30% by weight of chromium.

7. The part as set forth in claim 6, wherein said base alloy consists mainly of iron.

8. The part as set forth in claim 6 or 7, wherein said base and said cermet alloy layer have therebetween a boundary phase which contains a greater proportion by weight of components forming said binding phase than said binding phase does.

9. The part as set forth in claim 6, wherein said binding phase contains iron substituted for a part or all of said nickel.

10. The cermet alloy as set forth in claim 1, wherein said chromium in said binding phase has a weight ratio of between 0.02 and 0.4 to the total amount of said nickel and said chromium.

11. The composite mechanical part according to claim 6 wherein a diffusion layer exists between said base and cermet alloy layer.

* * * * *